US010080922B2

(12) United States Patent
Davis et al.

(10) Patent No.: US 10,080,922 B2
(45) Date of Patent: Sep. 25, 2018

(54) SWIMMING PADDLE

(71) Applicants: Guy Savaric Scott Davis, North Hampton, NH (US); Jonathan Walker Damon, Tiverton, RI (US)

(72) Inventors: Guy Savaric Scott Davis, North Hampton, NH (US); Jonathan Walker Damon, Tiverton, RI (US)

( * ) Notice: Subject to any disclaimer, the term of this patent is extended or adjusted under 35 U.S.C. 154(b) by 0 days.

(21) Appl. No.: 15/873,551

(22) Filed: Jan. 17, 2018

(65) Prior Publication Data

US 2018/0200579 A1 Jul. 19, 2018

Related U.S. Application Data

(60) Provisional application No. 62/447,737, filed on Jan. 18, 2017.

(51) Int. Cl.

*A63B 31/00* (2006.01)
*A63B 31/10* (2006.01)
*G08B 6/00* (2006.01)

(52) U.S. Cl.

CPC ..... *A63B 31/10* (2013.01); *G08B 6/00* (2013.01)

(58) Field of Classification Search

CPC ..... A63B 31/10; A63B 31/00; G08B 6/00
USPC ..... 441/55, 56, 57, 58, 59
See application file for complete search history.

(56) References Cited

U.S. PATENT DOCUMENTS 3,952,253 A 4/1976 Wan et al.
4,654,010 A 3/1987 Havriluk
4,763,284 A 8/1988 Carlin
5,663,897 A 9/1997 Geiser
5,857,947 A 1/1999 Dicker et al.
6,183,396 B1 2/2001 Reynier
6,743,023 B2 6/2004 Topolski
D585,104 S 1/2009 McCarthy
7,566,252 B2 7/2009 Bolster
7,677,939 B2 3/2010 Dahl
D683,414 S 5/2013 Bell
9,308,418 B2 4/2016 Davis et al.
9,424,703 B2 8/2016 Holm et al.

(Continued)

FOREIGN PATENT DOCUMENTS

GB 2477363 A 8/2011

OTHER PUBLICATIONS

"Top Swim Paddles Compared—The Expert Review," Julie Stupp, https://www.swimoutlet.com/blog/top-swim-paddles-comparedthe-gangloff-review, 14 pages, accessed Feb. 2, 2018.

(Continued)

*Primary Examiner* — Anthony D Wiest
(74) *Attorney, Agent, or Firm* — Knobbe Martens Olson & Bear LLP

(57) ABSTRACT

A swim paddle can include a low profile housing body including a hand surface and a water surface. The low profile housing body can further include a longitudinal axis that is parallel to the length of a hand of a swimmer and a transverse axis that is parallel to a width of the hand, wherein the longitudinal axis is longer than the transverse axis, and wherein the hand surface is adjacent to a palm of the hand. The paddle can further include a strap that can secure the low profile housing body with the hand of the swimmer. The swim paddle can further include an electronics package that can be affixed to the low profile housing body.

16 Claims, 10 Drawing Sheets

(56) References Cited

U.S. PATENT DOCUMENTS

| | | | | |
|---|---|---|---|---|
| 9,737,261 | B2 * | 8/2017 | Coza | A61B 5/6804 |
| 9,773,330 | B1 | 9/2017 | Douglas et al. | |
| 2007/0270283 | A1 | 11/2007 | Liu | |
| 2008/0081525 | A1 | 4/2008 | Dahl | |
| 2009/0318041 | A1 | 12/2009 | Murphy | |
| 2010/0110975 | A1 | 5/2010 | Cagenius | |
| 2010/0201512 | A1 | 8/2010 | Stirling et al. | |
| 2010/0204952 | A1 | 8/2010 | Irlam et al. | |
| 2010/0210975 | A1 | 8/2010 | Anthony, III et al. | |
| 2012/0009833 | A1 | 1/2012 | Doyle | |
| 2012/0072165 | A1 | 3/2012 | L'Energie et al. | |
| 2012/0129653 | A1 | 5/2012 | Shalev et al. | |
| 2013/0094710 | A1 | 4/2013 | Burton et al. | |
| 2013/0158687 | A1 | 6/2013 | Willenborg | |
| 2014/0149066 | A1 | 5/2014 | Holopainen et al. | |
| 2014/0180449 | A1 | 6/2014 | Sung | |
| 2014/0200116 | A1 | 7/2014 | Boutov et al. | |
| 2014/0278229 | A1 | 9/2014 | Hong et al. | |
| 2014/0305204 | A1 | 10/2014 | Hong et al. | |
| 2015/0017619 | A1 | 1/2015 | Ashmore | |
| 2015/0056878 | A1 | 2/2015 | Watchorn | |
| 2015/0185755 | A1 | 7/2015 | Summer et al. | |
| 2015/0314166 | A1 | 11/2015 | Hong et al. | |
| 2016/0051169 | A1 | 2/2016 | Hong et al. | |
| 2016/0067551 | A1 | 3/2016 | Tilson et al. | |
| 2017/0319133 | A1 * | 11/2017 | Coza | A61B 5/0022 |

OTHER PUBLICATIONS

"Catch and Pull in the Freestyle Stroke," http://swimsmooth.com/catch_adv.html, 5 pages, accessed Feb. 2, 2018.

"Compare Swim Watches to Find the Perfect One for You," https://www.swim.com/swim-watches, 5 pages, accessed Feb. 2, 2018.

"Waterproof Wearables are Approved by Swimmers," Zurine Dopacio Gonzalez, https://www.wearable-technologies.com/2016/03/waterproof-wearables-are-approved-by-swimmers/, 4 pages, published Mar. 11, 2016.

"Bolster Paddles, Early Vertical Forearm Paddles," https://www.finisswim.com/Bolster-Paddles, 2 pages, accessed Feb. 2, 2018.

Swim Master: "A Wearable Assistant for Swimmer," ETH Zurich, Wearable Computing Laboratory, Marc Bachlin, Filian Forster and Gerhard Troster, 10 pages, UhiComp 2009, Sep. 30-Oct. 3, 2009, Orlando, Florida, USA.

"Internal Sensor Technology for Elite Swimming Performance Analysis: A Systematic Review," Robert Mooney, Gavin Corley, Alan Godrey, Leo R. Quinlan and Gearoid O'Laighin, 55 pages, published Dec. 25, 2015.

ISR and Written Opinion dated Apr. 4, 2018, International Application No. PCT/US18/14094, filed Jan. 17, 2018.

* cited by examiner

SWIMMING PADDLE

CROSS-REFERENCE TO RELATED APPLICATIONS

This application claims the benefit of U.S. Provisional Application No. 62/447,737, filed Jan. 18, 2017, the entirety of this application is hereby incorporated by reference herein.

FIELD OF THE INVENTION

This disclosure relates to electrical systems for improving swimming hardware that is used for training swimmers.

BACKGROUND

In learning or practicing many sports, it is challenging for the athlete or participant to perceive precise orientation of their hands, arms, legs, head, and other parts of their body. This may be because the athlete cannot observe their orientation or their proprioceptive awareness is not sufficiently acute to sense the precise orientation of parts of the body. There are many sports, including swimming, for which spatial orientation of parts of the body is a significant determinant of effective technique.

In the specific case of swimming, an effective swimming stroke involves the movement of the hands, arms, shoulders, and other parts of the body through each swimming stroke cycle to generate forward thrust or propulsion while minimizing the water resistance to forward motion. To accomplish this, the swimmer must maintain a streamlined body position in the water while executing effective hand, limb and body movements to create forward propulsion. The spatial orientation of the hands, limbs, head and body, while executing the swimming stroke are important determinants of effective swimming technique for both propulsion and streamlining to minimize resistance and maximize speed. Additionally, proper technique can minimize the risk and severity of injuries as repetitive motions or strenuous body positions can cause injuries.

The physical nature of water and the mechanics of swimming present particular challenges for a person seeking to develop swimming skills. In addition to gravitational forces, water resistance and buoyant forces act on the swimmer's body while swimming. The combination of these forces make it challenging for the swimmer to perceive accurately the orientation and motions of their hands, arms, shoulders, legs, and other body parts in the water as they learn to develop effective swimming technique. Furthermore, the swimmer must focus on breathing, their position within the pool, count laps, keeping track of distance, timing of drill sets and a myriad of other tasks that can prevent the swimmer from focusing on their body position and orientation. Furthermore, the position of the head relative to the hands, limbs and other body parts can make it challenging or impossible for the swimmer to directly observe the orientation of key parts of their body while learning or practicing swimming.

Swimming paddles and similar devices have been used for many decades as devices to aid swimming effectiveness and for swim training. The devices have evolved with innovations based on the shape, size, hand/arm attachment method, materials, buoyancy, physical features and purpose. These devices include or are also referred to as hand and wrist paddles, palm plates, gloves, hand boards, hand fins, wrist flippers, body surfing hand boards, etc. There is a further need for improvements in the swimming paddles or swim hardware for training a swimmer.

SUMMARY

For purposes of summarizing the disclosure, certain aspects, advantages and novel features have been described herein. It is to be understood that not necessarily all such advantages can be achieved in accordance with any particular embodiment disclosed herein. Thus, the embodiments disclosed herein can be embodied or carried out in a manner that achieves or optimizes one advantage or group of advantages as taught or suggested herein without necessarily achieving others.

In certain embodiments, a swim paddle can include a low profile housing body including a hand surface and a water surface, the low profile housing body further including a longitudinal axis that is parallel to the length of a hand of a swimmer and a transverse axis that is parallel to a width of the hand, where the longitudinal axis is longer than the transverse axis, and where the hand surface is adjacent to a palm of the hand. Furthermore, the swim paddle can also include a strap configured to secure the low profile housing body with the hand of the swimmer. Moreover, the swim paddle can include an electronics package configured to be affixed to the low profile housing body. Further, the electronics package can include a haptic feedback generator, an orientation sensor, a battery, and a hardware processor. Furthermore, the hardware processor can receive orientation data from the orientation sensor over a first period of time, determine the angle between the longitudinal axis of the low profile housing body and a vertical axis that is perpendicular to a surface of water, and control the haptic feedback generator based on the determined angle.

The swim paddle of the preceding paragraph can have any sub-combination of the following features: where the electronics package is integrated with the low profile housing; where the electronics package has a first portion configured to be affixed to the water surface and comprises the haptic feedback generator; where the electronics package is positioned on the area of the hand surface configured to be adjacent to the groove on the palm of the hand; where the haptic feedback generator is positioned on the strap; where the feedback generator generates a haptic response based on the determined angle of 30 degrees; where the feedback generator generates a haptic response based on the determined angle of 20 degrees; where the feedback generator generates a haptic response based on the determined angle 10 degrees; where the haptic response comprises a pattern of vibration; where the electronics package further comprises a memory for storing data; or where the electronics package wirelessly connects to a wireless communication device.

In certain embodiments, an electronics package can include a haptic feedback generator, an orientation sensor, a battery, and a hardware processor. Furthermore, the hardware processor can receive orientation data from the orientation sensor over a first period of time, determine the angle between the longitudinal axis of the low profile housing body and a vertical axis that is perpendicular to a surface of water, and control the haptic feedback generator based on the determined angle. Moreover, the electronics package can be mounted to a swim paddle. The electronics package can also be mounted on a wearable device.

In certain embodiments, a method for controlling a haptic feedback generator included in a wearable device can include receiving orientation data from the orientation sensor over a first period of time. The method can further include determining the angle between the longitudinal axis of a low profile housing body of the wearable device and a vertical axis perpendicular to a surface of water. The method can also include controlling the haptic feedback generator based on the determined angle.

The method of the preceding paragraph can have any of sub-combination of the following features: where controlling the haptic feedback generator comprises generating a haptic response based on the determined angle of 30 degrees; where controlling the haptic feedback generator comprises generating a haptic response based on the determined angle of 20 degrees; where controlling the haptic feedback generator comprises generating a haptic response based on the determined angle of 10 degrees; further comprising storing orientation data received from the wearable device; further comprising wirelessly connecting to a wireless communication device.

BRIEF DESCRIPTION OF THE DRAWINGS

Throughout the drawings, reference numbers are used to indicate correspondence between referenced elements. The drawings are provided to illustrate embodiments of the features described herein and not to limit the scope thereof.

DETAILED DESCRIPTION

The present disclosure relates to systems and methods that can be incorporated or used with a wearable device for assisting a user to learn and practice a sports skill, including swimming. The system can provide real-time feedback to the user. This real-time feedback can be generated based on the spatial orientation of that part of the user's body where the wearable device is worn, such as the hand, limb, head or torso. The wearable device measures in real time while the person is performing the activity and the body part's spatial orientation and feedback is provided responsive to the measurements of the user's motions with limited time delay to no delay between a particular motion and corresponding feedback. The sensory feedback may include vibratory signals, visual signals, or audible signals.

It typically requires many years of deliberate practice to learn and refine the skills of efficient freestyle swimming. Common problems that developing swimmers face in achieving more efficient freestyle technique include "dropping the elbow" and/or "pushing down" on the water during the catch and pull phase of the stroke. Other errors swimmers face include crossing over the midline of the body, inefficient body rotation throughout the stroke, and over or under extension during the reach phase or the pull phase, and many other problems. These problems result in the swimmer generating a weaker propulsive force in the direction of travel and thus result slower and less efficient swimming. These problems can also lead to bodily injury, especially in the case of repetitive motions.

Traditionally, swimmers and coaches have relied primarily on coach observation and video analysis to provide feedback and instruction to the swimmer on improving the efficiency of their technique. These methods are limited in that they do not provide real-time sensory feedback to the swimmer. These methods do not provide feedback to the swimmer while he or she is swimming. The swimming paddles and other swim hardware may help the swimmers improve their technique. However, these paddles do not provide feedback and the swimmer is still susceptible to poor form. Furthermore, most developing swimmers lack the proprioception and sensory awareness (often informally described as "feel for the water") to fully perceive their movements while practicing (compounded by the challenges due to the physical nature of water) and thus find it difficult to make the appropriate adjustments to their hand and arm motions required to achieve more efficient technique.

Biofeedback System

Figure 1:
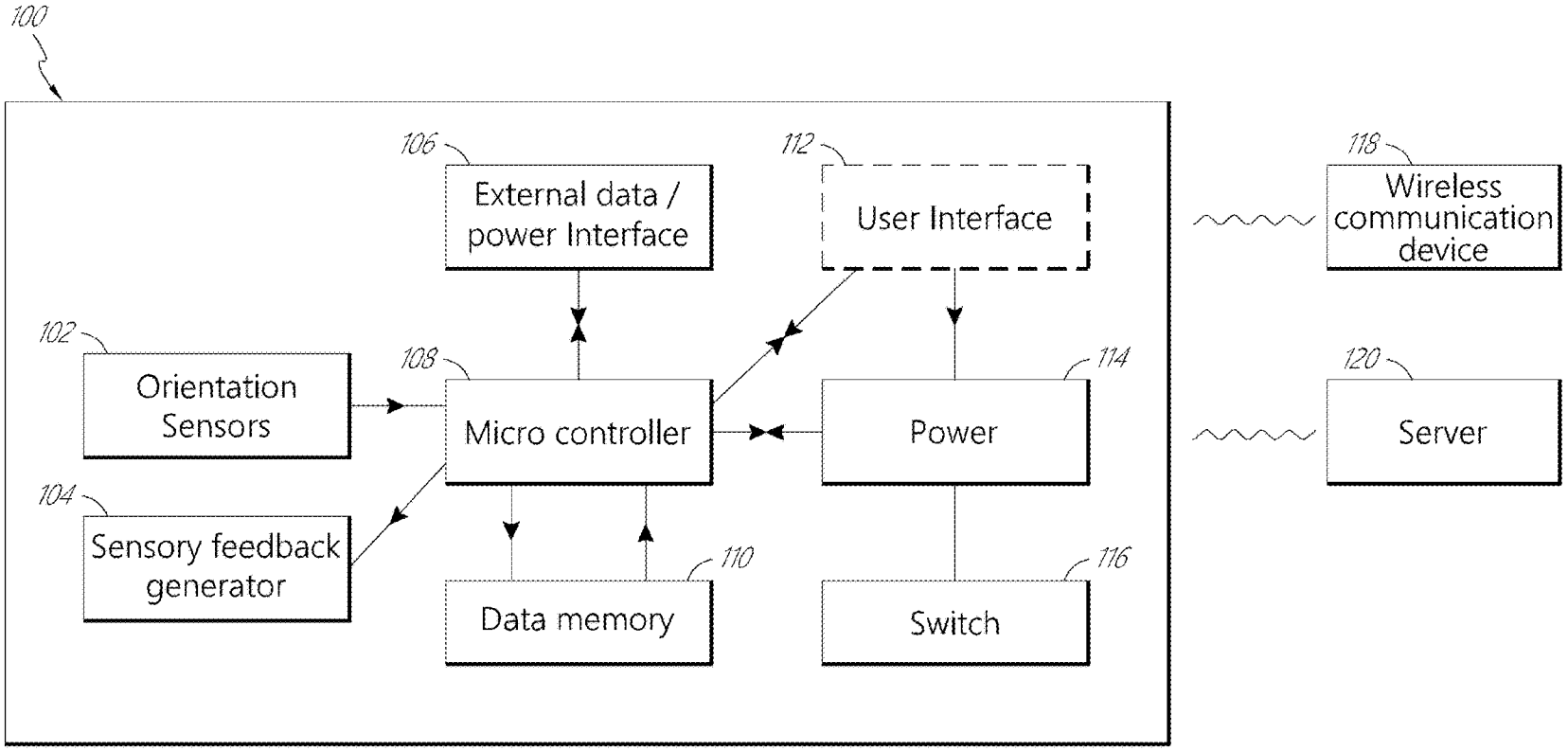
FIG. 1 illustrates a block diagram of a biofeedback system for a swim paddle or wearable device.

FIG. 1 illustrates a block diagram of an embodiment of a biofeedback system 100 that can be incorporated with a swim paddle or a wearable device. The biofeedback system 100 may include a sensory feedback generator 104, a microcontroller 108, a power source 114, and a switch 116. The biofeedback system 100 can also include an orientation sensor 102. In some embodiments, these electronics components of the biofeedback system 100 are combined in a single package for integration with the swim paddle of the wearable device. In other embodiments, these electronics components may be distributed in multiple packages and integrated in different locations on the swim paddle or the wearable device. For example, the orientation sensor 102 may be separate from other electronics of the biofeedback system 100. In other embodiments, the sensory feedback generator 104 may be separate from other components of the biofeedback system 100. The orientation sensor 102 may include any of the following alone or in combination: a three-axis accelerometer, a gyroscope, or a magnetometer. In some embodiments, the orientation sensor 102 is Adafruit LSM9DSO, which includes an accelerometer, a gyroscope, and a magnetometer. In some embodiments, the orientation sensor 102 can include a tilt or gravitational switch, an accelerometer, a gyroscope, a magnetometer, any other sensor or any combination thereof. The biofeedback system 100 may also include other types of sensors including pressure sensors.

The biofeedback system 100 may optionally include a user interface 112. The user interface 112 may include a display. The user interface 112 may also include an input (not shown) that can allow users to set parameters. The input can correspond to touch screen functionality of the display or a mechanical switch. The power source 114 may be a battery. The battery may be replaceable. The battery may also be rechargeable such that the device does not have to be unsealed once in a waterproof circuit housing.

The biofeedback system 100 may also include a hardware memory 110. The biofeedback system 100 could store specified orientation data generated over time by the orientation sensor while the device is in use in the hardware memory 110. The hardware memory 110 may also store predetermined angles and parameters for different swim strokes.

The biofeedback system 100 can wirelessly connect to a wireless communication device 118 such as a phone or tablet or server 120. The data can then be transferred to a computing device (such as a PC, tablet or smartphone) for further review and analysis by the user.

The sensory feedback generator 104 may produce lights, sound, or vibrations for user feedback. The biofeedback system 100 can include a switch 116 to turn the biofeedback system 100 on or off or for the user or coach to set operational parameters of the biofeedback system 100.

Biofeedback Method

The biofeedback system 100 can be used to assist the swimmer to adjust their technique to a more efficient motion while learning and practicing freestyle swimming. In some embodiments, the swimmer could use the biofeedback system 100 to learn and practice the arm motions of efficient freestyle swimming. The biofeedback system 100 is capable of sensing the orientation of a swim paddle, for example, and providing sensory feedback. In some embodiments, the swimmer could wear biofeedback system 100 on their hand and/or upper forearm while practicing swimming techniques or swimming drills. The swimmer may wear these biofeedback system 100 as part of a single device or a combination of multiple devices in a variety of positions on the body as described more in detail below.

Users may choose to use a swim paddle 200 worn on the hand or a wearable device 400 worn on the forearm as described below. Users may also use both devices simultaneously. Users may choose to use the device on a single hand or arm, to focus on technique for that hand or arm. Users may choose to use units on two hands or on two arms simultaneously, or any combination thereof.

The devices would be programmed to provide sensory feedback when close to the desired orientation. Thus the devices can provide sensory feedback to the swimmer and confirm that the orientation of the user's hand or forearm is close to the desired orientation. In the alternative, the user can also chose to selectively receive feedback when there is a deviation from the desired orientation. The user can also select frequency of feedback to conserve battery or to limit possible distraction from the sensory feedback. As the swimmer adapts and adjusts their motions, the device would provide additional sensory feedback to assist the user to achieve and practice the desired technique. Once the user has established the improved patterns of motion, assisted by the confirmatory sensory feedback provided by the device, the user would continue to practice the new motion to imprint or pattern the new motor skill through muscle memory. The swimmer and coach could test the efficiency improvements of the adapted technique through performance measures such as speed and distance-per-stroke.

Swim Paddle

Figure 2A:
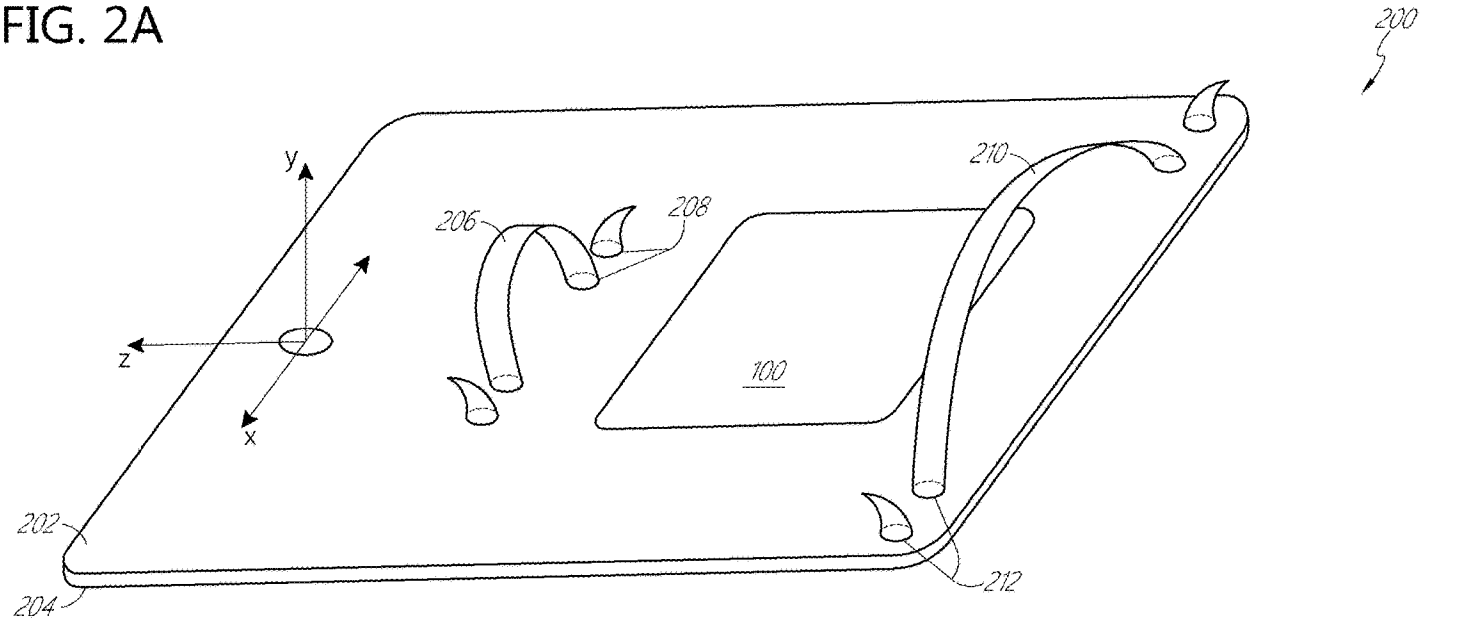
FIGS. 2A-B illustrate an embodiment of a swim paddle worn on the user's hand capable of measuring orientation and providing sensory feedback to the user.
Figure 2B:
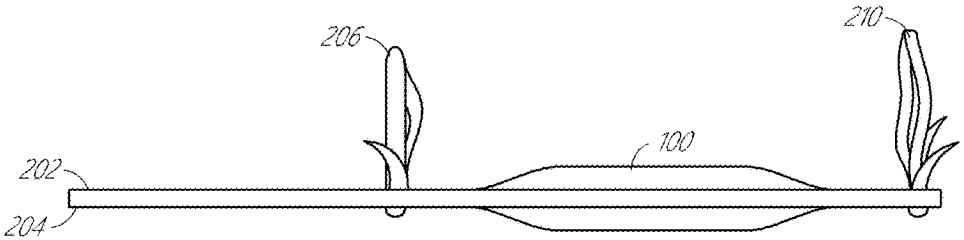

FIGS. 2A-B illustrate an embodiment of a swim paddle 200 including a biofeedback system 100 that is capable of measuring orientation and providing sensory feedback to the user. The swim paddle 200 may be worn on the user's hand while swimming with the biofeedback system 100 embedded in or mounted on the swim paddle 200 as shown in FIG. 2.

The swim paddle 200 may be approximately rectangular, square, triangular, circular, similar to the shape of a hand, and a variety of other shapes. In an embodiment, the size of the swim paddle 200 is sufficient to fill all the electronics of the biofeedback system 100. The swim paddle 200 may have various dimensions for thickness, length, and width. In the illustrated embodiment, the swim paddle 200 is approximately rectangular in shape. The swim paddle 200 may be approximately 4 to approximately 9 inches in length. The swim paddle 200 may be approximately 3 to approximately 5 inches in width. The swim paddle 200 may be approximately 1/16 to approximately 1/8 inches in thickness. In some embodiments, the swim paddle 200 may be significantly smaller than the palm of the user's hand. In some embodiments, the swim paddle 200 may be shaped and sized to fit in a the center of the user's palm, around four fingers, around three fingers, around two fingers, around one finger or in many other positions.

The swim paddle 200 may be approximately shaped for use by an adult male. The surface area of the swim paddle 200 can be approximately the surface area of the best fit rectangle that includes the adult male hand. The swim paddle 200 may have larger or smaller relative proportions may be suitable hand sizes of larger and smaller adult or youth males or females.

The swim paddle 200 may be constructed of a rigid material, such as a rigid plastic. In an embodiment, the swim paddle 200 is made of polypropylene. The swim paddle 200 may be appropriately sized to maximize the contact between the user's hand and the surface of the swim paddle 200. The swim paddle 200 may also be appropriately curved or shaped to the contours of the user's hand to maximize contact between the user's hand and the surface of the swim paddle 200. Maximizing the area of contact between the surface of the user's hand and the swim paddle 200 can maximize the haptic feedback received by the user, as described more below.

The swim paddle 200 includes a proximal side 202 and a distal side 204. The proximal side 202 may be the contacting surface for the palm of the hand of the user. The distal side 204 may be the opposing side of the proximal side 202. The distal side 204 may be the contacting surface for the initial contact with the surface of the water. Accordingly, in some embodiments, the biofeedback system 100 is included only on the proximal side 202. FIG. 2B shows exaggerated raised edges on both sides for the purposes of illustration. However, the biofeedback system 100 may be incorporated only on one of the sides. The swim paddle 200 may be substantially flat for ease of manufacture and use as shown in FIGS. 5A-B. The swim paddle 200 may also be curved to fit the natural curve of the hand for user comfort.

The swim paddle 200 can have at least one or more attachment structures including finger retention structure 206. In one embodiment, the swim paddle 200 includes a single finger retention strap 206. The swim paddle 200 can include several finger retention apertures 208 for receiving tubing as the finger retention structure 206. In some embodiments, the swim paddle 200 includes a wrist retention strap 210. The swim paddle 200 can include several wrist retention apertures 212 for receiving tubing as the wrist retention structure 210. The tubing for the retention structures may be latex surgical tubing or any other flexible or elastic material for user comfort.

Figure 3A:
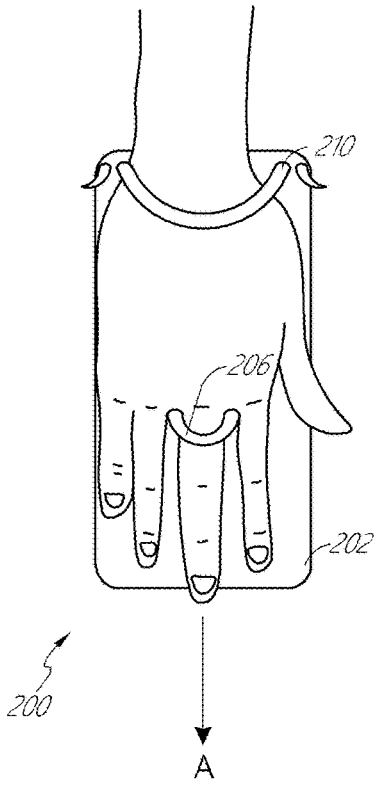
FIGS. 3A-B illustrate angular displacement of the swim paddle with respect to surface of a water.

In some embodiments, the retention structures may include a finger retention strap 206 designed to retain the middle finger of the user's hand as shown in FIG. 3A. The finger retention structure 206 may be centrally placed in the swim paddle 200 such that when the user is wearing the paddle, their middle finger can be aligned with the z-axis of the orientation sensor 102. In other embodiments, the swim paddle 200 can include several other types of retention structures for different fingers or different parts of the hand. In other embodiments, the swim paddle 200 can include a combination of various types of retention structures.

In other embodiments, the swim paddle 200 can include built in retention apertures to attach the swim paddle 200 to the user's hand without straps. In one embodiment, the swim paddle 200 may have a thumb aperture such that the user's thumb can be inserted into the aperture. In some embodiments, the swim paddle 200 may be curved and conformed to the hand such that the user can comfortably insert their thumb into the thumb aperture and the swim paddle 200 will remain attached to the user's hand.

FIG. 3 illustrates angular displacement with respect to the swim paddle 200. The biofeedback system 100 may be embedded in or attached to the swim paddle 200. The biofeedback system 100 may be encapsulated by waterproof housing. The biofeedback system 100 including a waterproof housing may also include an adhesive for attachment with the swim paddle 200. The adhesive may include glue, Velcro, magnetic, or mechanical screws for attaching the biofeedback system 100 to the swim paddle 200. The waterproof housing may protrude from the surface of the swim paddle 200 as shown in FIG. 2B. This may increase contact of the biofeedback system 100 elements, such as the sensory feedback generator 104, with the surface of the hand. This may also increase the user's feel and reception of the sensory feedback. In other embodiments, the biofeedback system 100 may be embedded into the swim paddle 200 such that the surface of the swim paddle 200 is flat as discussed above.

The biofeedback system 100 may be a variety of shapes including square, rectangular, circular, triangular, and any other appropriate shape. The biofeedback system 100 may have dimensions of approximately 1 to approximately 5 inches in length and width. The biofeedback system 100 may be approximately 1/16 to approximately 1/4 inch in thickness.

Figure 3B:
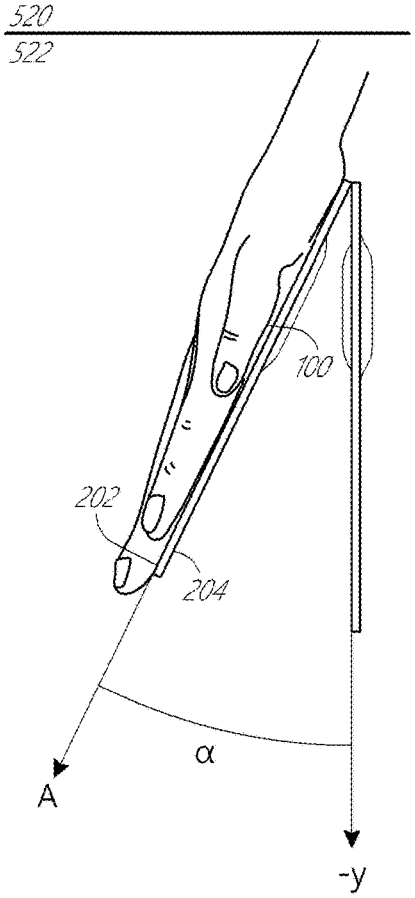

The biofeedback system 100 may be placed on either the proximal side 202 or distal side 204 of the swim paddle 200. In some embodiments, the biofeedback system 100 can be embedded into the swim paddle 100200. The biofeedback system 100 may be positioned between the retention structures 206, 210 as shown in FIG. 2A. The biofeedback system 100 may be positioned under the center of the palm placement of the hand as shown in FIG. 3B. In some embodiments, the biofeedback system 100 may include a sensory feedback generator 104 that be positioned on the swim paddle 200 such that a vibration signal can be transmitted throughout the rigid structure of the swim paddle 200. In some embodiments, the sensory feedback generator 104 can be separate from the biofeedback system 100. The sensory feedback generator 104 can be placed on the proximal side 202 of the swim paddle 200. The sensory feedback generator 104 can also be placed on the retention structures.

As discussed above, the biofeedback system 100 may include one or more orientation sensors 102, such as a three-axis accelerometer, a gyroscope, and a magnetometer. In one embodiment, the biofeedback system 100 may be aligned such that the z-axis of the orientation sensor 102 is aligned with the z-axis of the swim paddle 200 as shown in FIG. 2A.

In some embodiments, the orientation sensor 102 may be aligned to measure the direction vector A shown in FIG. 3A. The direction vector A measures the orientation of the swim paddle 200 worn on the hand. The direction vector A can be defined as the z-axis of the swim paddle 200. As shown in FIG. 3A, the z-axis of the paddle can be parallel to the length of the swim paddle 200. The z-axis of the orientation sensor 102 can be positioned to be aligned with the direction vector A. The orientation of the direction vector A corresponds to the orientation of the hand. The orientation sensor 102 of the biofeedback system 100 measures the orientation of the swim paddle 200 and therefore the hand.

Figure 5:
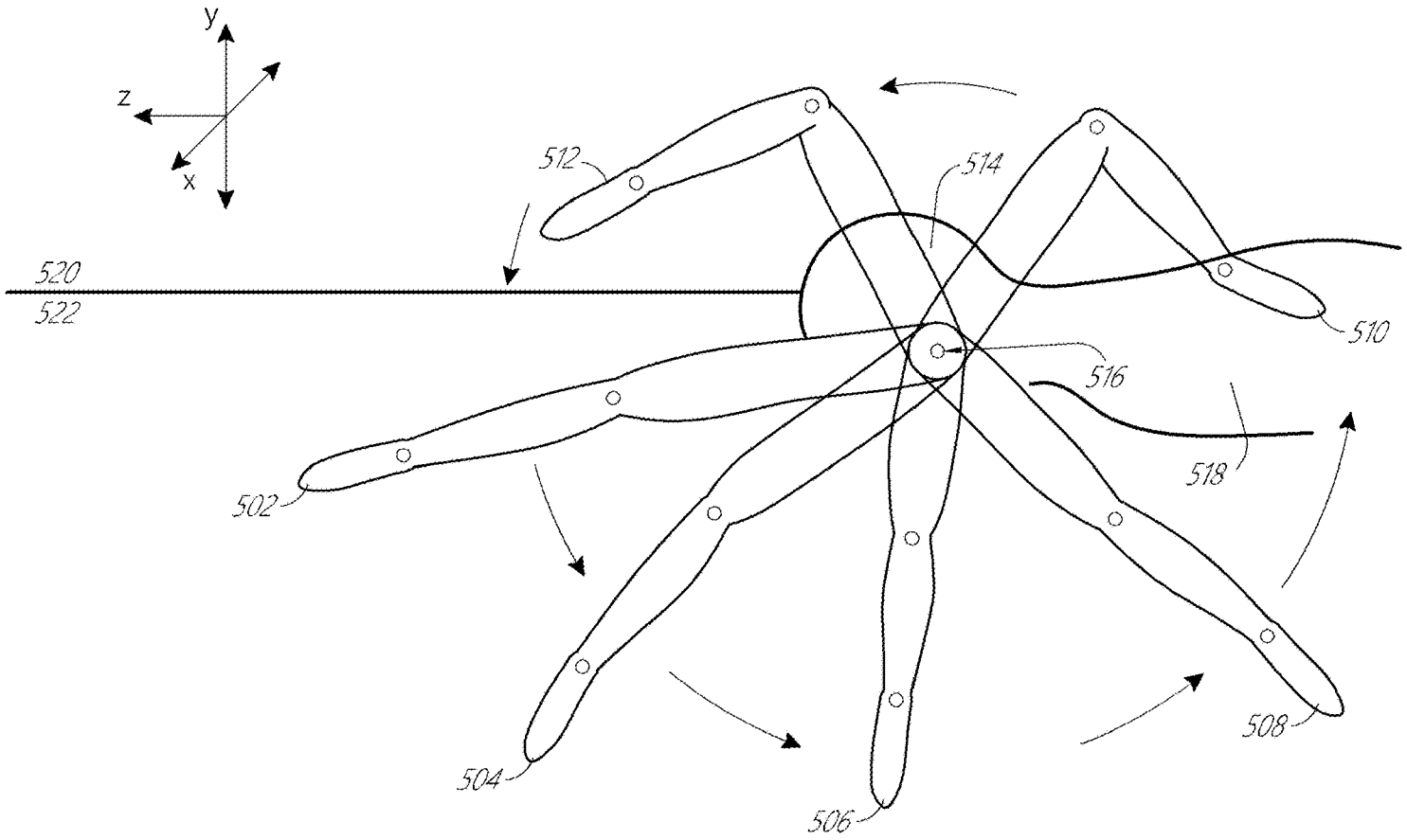
FIG. 5 illustrates the phases of the movement of the arms during the freestyle stroke.

The biofeedback system 100 included in a swim paddle 200 can provide sensory feedback based on the angle of deviation from the negative y-axis. The sensory feedback generation process 900 is described more below. As shown in FIG. 5, the z-axis can be defined as the direction of forward motion of the swimmer and parallel to the length of the swimmer's body. The z-axis can be defined as parallel to the surface of the water 520. The y-axis can be defined as perpendicular to the z-axis. The negative y-axis can point from the surface of the water 520 to the floor of the pool. As shown in FIG. 3B, the angle $\alpha$ can be defined as the angle of deviation of the direction vector A from the negative y-axis. When the angle $\alpha$ is within a certain predefined range, the swim paddle 200 can provide sensory feedback to the user.

In one embodiment, as discussed more below, the desired angle of orientation can be when the hand is parallel to the negative y-axis. The swimmer can set and program the biofeedback system 100 in the swim paddle 200 such that sensory feedback can be generated when the swim paddle 200 is close to parallel to the negative y-axis. The swim paddle 200 can generate and provide sensory feedback when the angle $\alpha$ is within a certain predefined range from the negative y-axis. For example, the range for $\alpha$ might be set at approximately 10 degrees deviation from the negative y-axis. In some embodiments, the range for $\alpha$ might be set at 15 degrees or 20 degrees from the negative y-axis. In some embodiments, the range for $\alpha$ can be both in the plus or minus direction away from the negative y-axis.

The user can specify the desired orientation and ranges for sensory feedback. Given the additional degree of freedom in optimization of the orientation of the hand as a result of wrist flexion, a user of a particular skill level may specify wider range of deviation for $\alpha$ that they may set for a swim paddle 200.

Wearable Device

In some embodiments, the biofeedback system 100 can be incorporated with a wearable device 400 worn by the user. The wearable device 400 may be a swimming training aid that is capable of sensing orientation and providing haptic feedback. The operation of the wearable device 400 would be similar to the operation of the swim paddle 200 as discussed above.

In some embodiments, the wearable device 400 may be designed to be worn by the user. The wearable device 400 may include waterproof housing 402 to enclose the biofeedback system 100. The waterproof housing 402 may also incorporate attachment structures 404. In some embodiments, the waterproof housing 402 includes apertures for receiving elastic strapping as the attachment structure 404. The waterproof housing 402 can have two faces, a proximal face 406 that contacts the surface of the body part and a distal face 404 as shown in FIG. 4C. The waterproof housing 402 may have slight curvature as shown in the profile view of the device 400 shown in FIG. 4C. The waterproof housing 402 may also include a layer of silicone rubber or similar material may be adhered to the proximal face 406 to assist in securing the device 400 to the user and for the user's comfort.

Figure 4A:
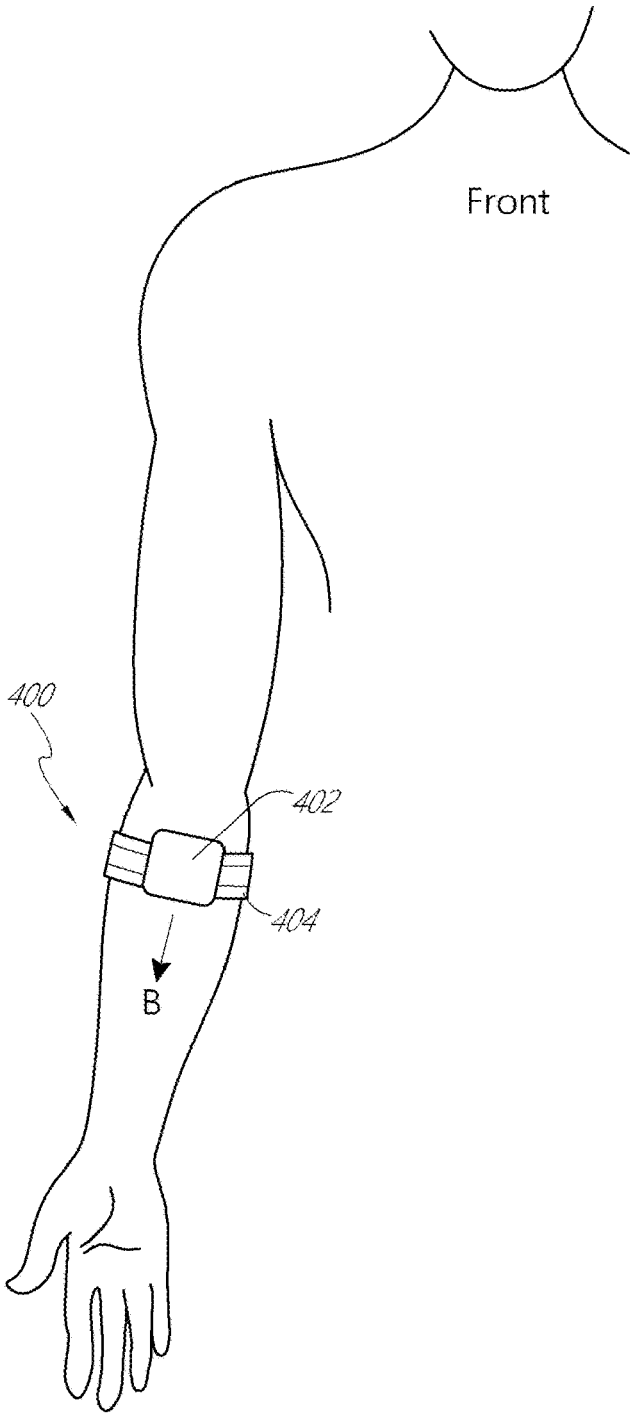
FIGS. 4A-C illustrate an embodiment of a wearable device capable of measuring orientation and providing sensory feedback to the user.

In one embodiment, the wearable device 400 may be worn on the forearm, as shown in FIG. 4A. In other embodiments, the wearable device 400 may also be worn around the wrist, upper arm, hand, or fingers. In other embodiments, the wearable device 400 may be worn on the leg or other parts of the user's body. The attachment structure 404 may be appropriately sized and made of material to fit on the user's forearm. In other embodiments, the attachment structure 404 may be appropriately sized to fit on other body parts of the user.

The biofeedback system 100 may be placed on either the proximal side 406 or distal side 404 of the wearable device 400. The biofeedback system 100 may be positioned between the attachment structure 404 and against the surface of the user's body part. The biofeedback system 100 may be a variety of shapes including square, rectangular, circular, triangular, and any other appropriate shape. The biofeedback system 100 may be approximately 1 to approximately 3 inches square. The biofeedback system 100 may be approximately 1/16 to approximately 1/4 inch in thickness. The waterproof housing 402 would be appropriately sized to enclose the biofeedback system 100. The sensory feedback generator 102 may be integrated with the biofeedback system 100. The sensory feedback generator 102 may also be separate from the biofeedback system 100. The sensory feedback generator 102 may be placed on the proximal side of the wearable device 400. The sensory feedback generator 104 can also be placed on the attachment structure 404.

Figure 4B:
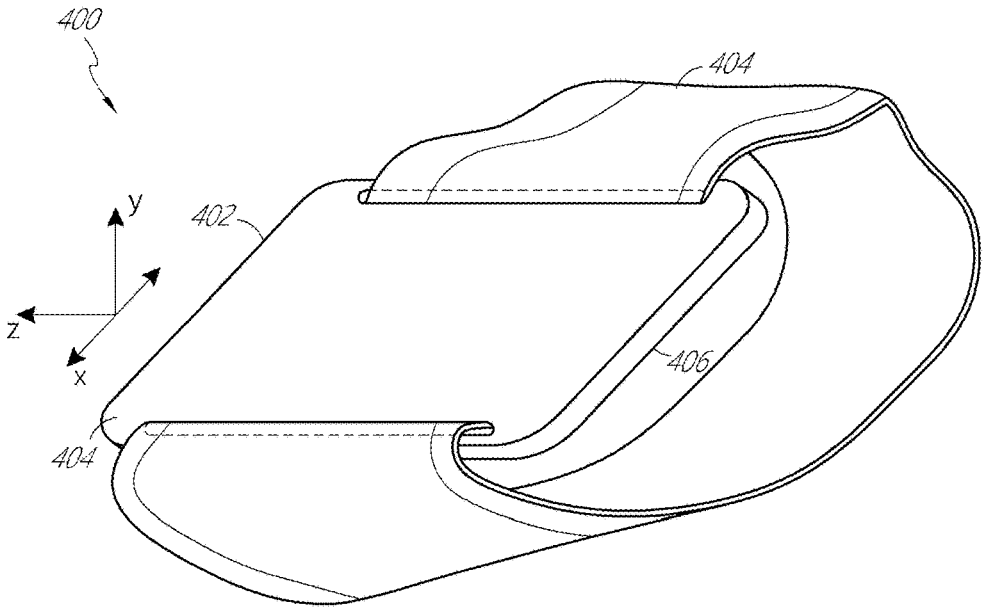
Figure 4C:
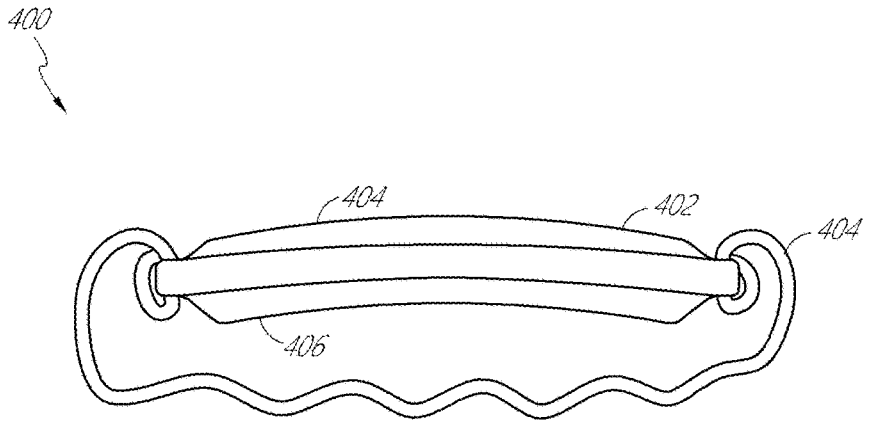

The biofeedback system 100 may include one or more orientation sensors 102, such as a three-axis accelerometer, a gyroscope, and a magnetometer. In some embodiments, the orientation sensor 102 may be aligned to measure the direction vector B shown in FIG. 4A. The direction vector B measures the orientation of the wearable device 400. The direction vector B can be defined as the z-axis of the wearable device 400. As shown in FIG. 4B, the z-axis of the wearable device 400 can be parallel to the length of the wearable device 400 as shown in FIG. 4B. When the wearable device 400 is worn on the anterior forearm, the z-axis of the wearable device 400 can be parallel to the length of the forearm. The z-axis of the orientation sensor 102 can be positioned to be aligned with the direction vector B. The orientation of the direction vector B corresponds to the orientation of the forearm. The orientation sensors 102 of the biofeedback system 100 measures the orientation of the wearable device 400 and therefore the forearm.

The wearable device 400 would provide sensory feedback based on the angle of deviation from the negative y-axis. This sensory feedback generation process 900 is described more below. The angle β can be defined as the angle of deviation of the direction vector B from the negative y-axis. When the angle β is within a certain predefined range, the wearable device 400 can provide sensory feedback to the user.

In one embodiment, the swimmer can set and program the wearable device 400 such that sensory feedback would be generated and provided when the wearable device 400 is close to parallel to the negative y-axis. The wearable device 400 can generate and provide sensory feedback when the angle β is within a certain predefined range from the negative y-axis. For example, the range for β might be set at plus or minus 10 degrees deviation from the negative y-axis. In some embodiments, the range for β might be set at plus or minus 15 degrees from the negative y-axis.

In some embodiments, the swimmer can use both the swim paddle 200 and the wearable device 400 simultaneously. Both the swim paddle 200 and the wearable device 400 can each be programmed to generate and provide sensory feedback to the user. In some embodiments, the swimmer would set and program the devices such that sensory feedback would be generated and provided when the devices are close to the negative y-axis. In some embodiments, the device can generate and provide sensory feedback when the angle α or β is within a certain predefined range from the negative y-axis. For example, the range for α might be set at plus or minus 10 degrees deviation from the negative y-axis, while the range for β might be plus or minus 20 degrees from the negative y-axis. The direction vector A of the swim paddle 200 and the direction vector B of the wearable device 400 are not always aligned. Due to the bend in the wrist joint, the hand and forearm can have different orientations. The swimmer may be able to achieve the desired orientation in the one body part, but not another body part. For example, the swimmer's hand can achieve a desired vertical orientation while the forearm is not substantially vertical. For example, the swimmer's wrist can be bent at the initiation of the catch phase such that the hand reaches a vertical orientation independently from the forearm. At this phase, the swim paddle 200 may provide sensory feedback to the user when the hand is close to a vertical orientation. As the swimmer moves into the pull phase, the hand and forearm may come into alignment. At this phase, the swim paddle 200 and the wearable device 400 may both provide sensory feedback to the user as both the hand and forearm are close to the vertical orientation. Therefore, the swim paddle 200 and the wearable device 400 can provide independent sensory feedback to the user based on the orientations of the hand and forearm.

Phases of Arm Cycle in Freestyle Swimming

FIG. 5 illustrates the phases of the arm cycle of swimming the freestyle stroke.

The biofeedback system 100 can measure and collect data relating to the velocity, direction, timing, angles, and positions of the swimmer's body. The biofeedback system 100 can compare the collected data to thresholds and predetermined motions to assist the user in training and developing swim techniques. The biofeedback system 100 may also collect other measures of swimming efficiency and technique such as speed and distance-per-stroke. The biofeedback system 100 can store specified orientation data generated over time by the orientation sensor. The data can then be subsequently transferred to a computing device (such as a PC, tablet or smartphone) for further review and analysis by the user.

The freestyle stroke combines a complex series of interrelated and coordinated movements of the swimmer's hands and arms at the shoulder 516, elbow and wrist, combined with coordinated rotation of the torso 518. In addition, these movements must be combined with the motions of the head 514, torso 518 and legs (not shown) to maintain a streamlined body position in the water to minimize water resistance, to breathe and to generate further propulsion from the legs and feet.

In relation to the movements of the arms, the freestyle stroke cycle can be described in four principal phases: the "reach" phase 502; the "catch" phase 504; the "pull" phase 506, 508; and the "recovery" phase 510, 512. These phases are illustrated in FIG. 5.

The swimmer's head 514, shoulder 516, torso 518, legs (not shown) are aligned substantially parallel to the surface of the water and substantially parallel to the direction of the forward motion as shown by the positive z-axis, as shown in FIG. 5. FIG. 5 illustrates the motion of the arm as the swimmer goes through the four principal phases of the freestyle stroke. While FIG. 5 illustrates only one arm of the body as it goes through the motions of the freestyle stroke, but the swimmer may use both arms in coordinated, synchronized motion. The swimmer's arm moves through the phases of the freestyle stroke in a repetitive, clockwise fashion. The biofeedback system 100 can track this motion and provide feedback.

In the first phase, the swimmer's arm in the "reach" phase 502 of the freestyle stroke. The swimmer places their arm forward, positioned in front of their head 514, to enter the water. The swimmer's hand and arm are extended with minimal bend in the elbow during the "reach" phase 502. The swimmer's hand and arm are substantially aligned and in a horizontal orientation, parallel to the z-axis. The biofeedback system 100 can measure data relating to the extension and position of the hand and arm during this phase. In one embodiment, the biofeedback system 100 can provide feedback to the user to develop the desired horizontal orientation of the hand and arm.

In the second phase, the swimmer's arm is in the "catch" phase 504 of the freestyle stroke. This phase can be named the "catch" phase 504 because it refers to the point in which the swimmer's hand begins to create forward propulsion from connection with the water to initiate the pull phase 506, 508. In the catch phase 504, the swimmer moves their hand and forearm from a horizontal orientation, parallel to the z-axis, into a vertical or near vertical orientation, parallel to the y-axis. The upper arm remains closer to a horizontal orientation, parallel to the z-axis, with a bend in the elbow. In the catch phase 504, the motion of the hand and the arm produce limited propulsive forces in the direction of travel, along the z-axis. The hand and arm in placed in position to maximize the forward propulsive forces generated during the next phase, the "pull" phase 506, 508. The biofeedback system 100 can measure the orientation of the hand and arm and provide feedback to the user as described more below.

In the third phase, the swimmer's arm is in the "pull" phase 506, 508 of the stroke, which is illustrated in FIG. 5. The pull phase 506, 508 can be broken down into two subphases: the mid-pull phase 506 and the late pull phase 508. In the pull phase 506, 508, the swimmer moves their hand and arm from in front of the head to alongside the torso 518 and underneath the body. The swimmer moves their arm through the water to follow the length of their body. The pull phase 506, 508 can generate a propulsive force in the direction of forward motion, in the positive z direction. During the mid-pull phase 506, the swimmer's arm and hand can reach a substantially vertical orientation, parallel to the negative y-axis. During the late-pull phase 508, the swimmer's arm can be extended to follow the length of the swimmer's torso 518. The swimmer's arm can be in a substantial horizontal orientation, parallel to the negative z-axis, and can be positioned behind the swimmer's head 514. In the pull phase 506, 508, the orientations of the forearm and the hand while this motion are critically important to the efficiency with which the motion of the hand and arm generate forward propulsion. The biofeedback system 100 can measure the orientation of the hand and arm and provide feedback to the user as described more below.

At the conclusion of the "pull" phase, the swimmer can move into the recovery phase 510, 512 of the freestyle stroke. In the fourth phase, the swimmer's arm is in the "recovery" phase 510, 512 of the freestyle stroke, which is illustrated in FIG. 5. The recovery phase 510, 512 can be broken down into two sub-phases: the early recovery phase 510 and the later recover phase 512. In the recovery phase 510, 512, the swimmer can move their hand and arm from the water 522 by lifting the arm and hand from the water 522 into the air 520. In the early recovery phase 510, the swimmer can move their arm from underneath the surface of the water 512 to above the water 522. In the later recovery phase 512, the swimmer can moves their arm and hand from behind the swimmer's head 514 to the front of the swimmer's head 514 in a positive z-direction. The swimmer's arm can be substantially bent at the elbow throughout the recovery phase 510, 512. The swimmer's arm can be moved to a position in front of the head 514 and torso 518 before the next "reach" phase 502 begins the next swimming stroke cycle. The biofeedback system 100 can measure the velocity or angles of the hand and arm to provide feedback to the user. In one embodiment, the biofeedback system 100 can measure the velocity of the arm as it moves in the forward z-direction of the recovery phase.

Figure 6:
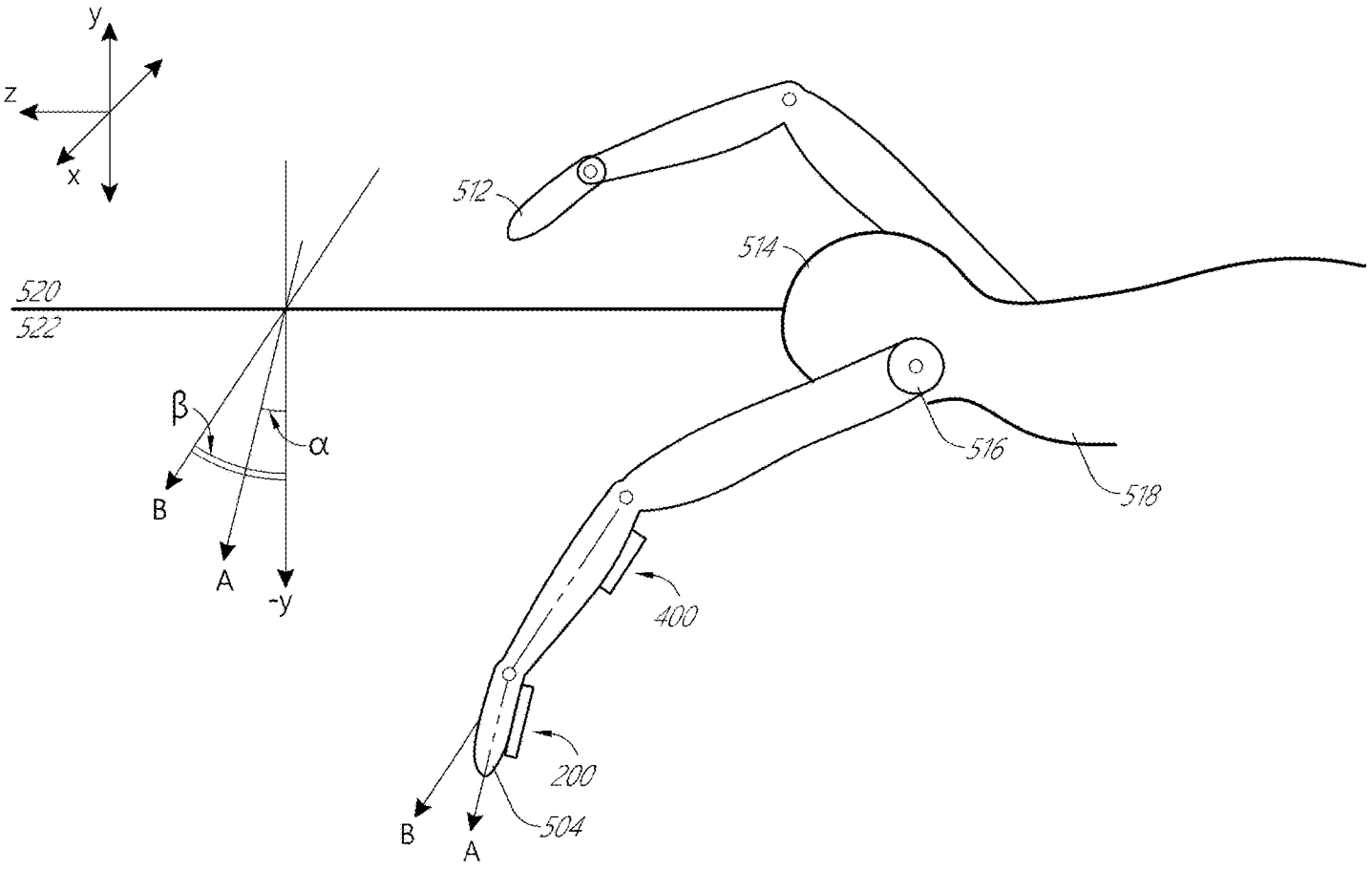
FIG. 6 illustrates the use of the swim paddle illustrated in FIGS. 1A and 1B and a device according to FIGS. 4A-4C.
Figure 7:
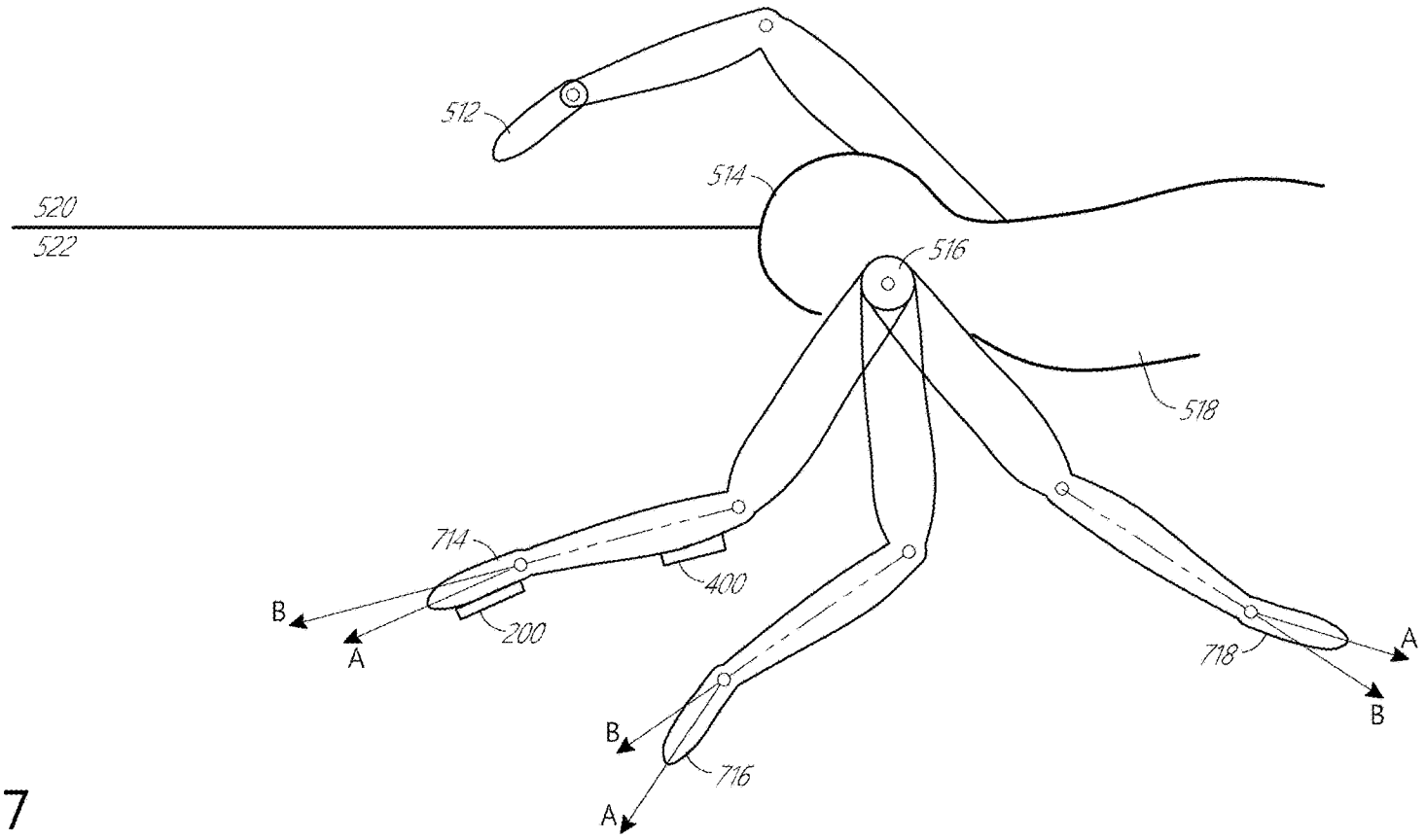
FIG. 7 illustrates the phases of movement of the arms during an inefficient freestyle stroke with a dropped elbow position.

FIG. 7 illustrates the phases of movement of the arms during an inefficient freestyle stroke with a dropped elbow position. The swimmer's arm is shown in the late recovery phase 512, the catch phase 714, the mid-pull phase 716, and the late-pull phase 718. The late recovery phase 512 and the late pull phase 508 can be similar to the late recovery phase 512 and the late pull phase 718 of the swimmer in FIG. 6 as described above. The swimmer can wear the swim paddle 200 on the hand and a wearable device 400 on the anterior forearm as shown in FIG. 7.

Figure 8:
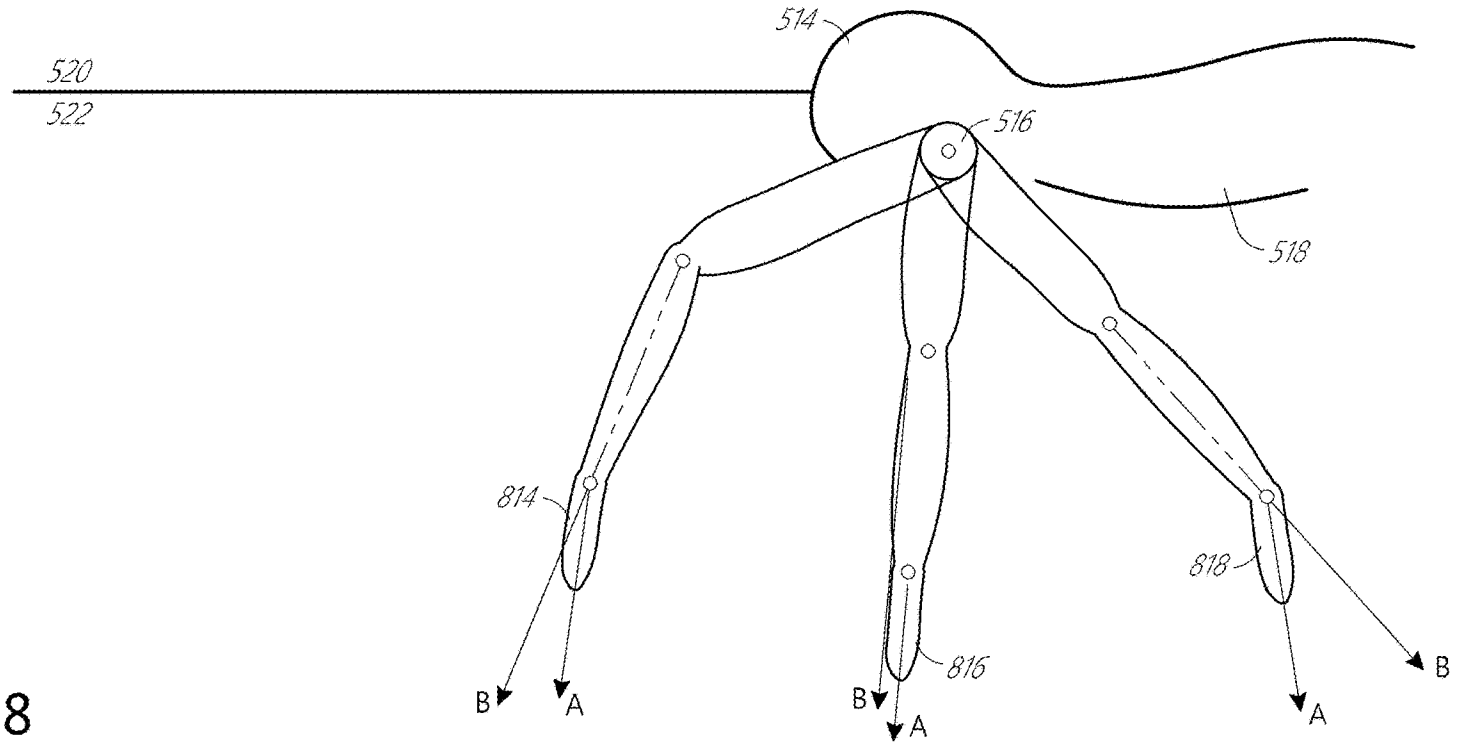
FIG. 8 illustrates the phase of movement of the arms during a highly efficient freestyle stroke with a high elbow position.

FIG. 8 illustrates the phases of movement of the arms during an efficient freestyle stroke with a high elbow catch. The swimmer's arm is shown in the catch phase 814, the mid-pull phase 816, and the late-pull phase 818.

In the catch phase 714, the swimmer's arm has a dropped elbow, as shown in FIG. 7. When executed with inefficient technique, the swimmer's upper arm is closer to a vertical orientation, parallel to the y-axis. When executed with inefficient technique, the swimmer's forearm is closer to a horizontal orientation, parallel to the z axis. In contrast, as shown in FIG. 8, the swimmer's arm has a high elbow in the catch phase 814. When executed with efficient technique, the swimmer's upper arm remains closer to a horizontal orientation, parallel to the z-axis. When executed with efficient technique, the swimmer's forearm is closer to a vertical orientation, parallel to the y-axis. These motions and corresponding orientation data and/or velocity can be stored in the memory of the biofeedback system 100. The biofeedback system 100 can measure the orientation of the swimmer's upper arm, forearm, and/or hand and compare it with the stored data to determine whether the swimmer is employing an efficient technique. Based on the comparison, the biofeedback system 100 can provide feedback and assist the user in executing an efficient technique.

The elbow is considered a dropped elbow in the catch phase 714 because it is positioned below, in the negative y direction, the position of the elbow in the catch phase 814. The hand and arm are in an inefficient position such that limited propulsive forces are generated during the next phase. In FIG. 8, the elbow is considered a high elbow in the catch phase 814 because it is positioned higher in the positive y direction relative to the elbow of the inefficient stroke technique as shown in FIG. 7.

An inefficient pull phase generates minimal propulsive force in the direction of forward motion. With inefficient technique, during the mid-pull phase 716, the swimmer's arm and hand fails to reach a substantially vertical orientation, such that the arm is not positioned parallel to the y-axis, as shown in FIG. 7. An efficient pull phase generates maximum propulsive force in the direction of forward motion, the positive z direction. This is contrast to the mid-pull phase 816 when executed with efficient technique where the swimmer's arm and hand reaches a substantially vertical orientation, parallel to the y-axis, as shown in FIG. 8. In some embodiments, the biofeedback system 100 can collect measurements related to the speed and distance of the pull phase to provide feedback to the user.

Early Vertical Forearm (EVF) or High Elbow Catch Mode

In one embodiment, the swimmer use the device including the biofeedback system 100 to achieve a desirable "high elbow catch" or "early vertical forearm" swimming form or technique. Embodiments of the device including the biofeedback system 100 can provide the swimmer with sensory feedback from a swim paddle 200 worn on the swimmer's hand and a wearable device 400 strapped to the anterior forearm below the elbow to learn and practice the "high elbow catch" or "early vertical forearm" technique while swimming the freestyle stroke.

FIGS. 6, 7, and 8 illustrate an embodiment of a method of use of two devices including the biofeedback system 100 to assist a swimmer to develop the "early vertical forearm" or "high elbow catch" technique. In this embodiment, the swimmer could use a device embodied in a swim paddle 200 worn on the user's hand and a second device 400 worn on the user's anterior forearm. This is illustrated in FIGS. 6, 7, and 8. As defined above, A can be defined as the direction vector of the swim paddle 200 worn on the hand. A can be parallel to the longitudinal axis of the swim paddle and parallel to the z-axis of the swim paddle as shown in FIG. 1A. Also defined above, B can be defined as the direction vector of the second device 400 worn on the user's anterior forearm as shown in FIG. 4A.

FIG. 6 illustrates the use of a swim paddle 200 worn on the hand and a device 400 worn on the anterior forearm during the freestyle stroke. The negative y-axis can be defined as the direction from the surface of the water to the pool floor as shown in FIG. 6. $\alpha$ and $\beta$ are the deviations of the direction vectors A and B from the negative y-axis. The swimmer would set and program the devices such that sensory feedback would be generated and provided when the devices are close to the negative y-axis. In this "early vertical forearm mode" the desired angle of orientation would be the parallel to the negative y-axis. In some embodiments, the device can generate and provide sensory feedback when the angle $\alpha$ or $\beta$ is within a certain predefined range from the negative y-axis. For example, the range for $\alpha$ might be set at plus or minus 10 degrees from the negative y-axis, while the range for $\beta$ might be plus or minus 20 degrees from the negative y-axis. In some embodiments, the range for $\alpha$ might be set at plus or minus 15 degrees from the negative y-axis.

The direction vectors A and B of the devices including the biofeedback system 100 are not always aligned as discussed above. The use of multiple devices including the biofeedback system 100 can give the user feedback based on measurements of orientation of multiple body parts. For example, the swimmer can use a swim paddle 200 and a wearable device 400 on the forearm. Due to the bend in the wrist joint, the hand and forearm can have different orientations. The swimmer may be able to achieve the desired orientation in the one body part, but not another body part. For example, the swimmer's hand can achieve a desired vertical orientation while the forearm is not substantially vertical.

FIG. 7 illustrates a swimmer with inefficient freestyle technique incorporating a "dropped elbow." The palm and the forearm are horizontally oriented at the catch phase 714 and pull phase 716 of the stroke. The biofeedback system 100 could not generate or provide positive sensory feedback to the user during these phases. In the alternative, the biofeedback system 100 can generate feedback also during inefficient motion. In some embodiments, the biofeedback system 100 can provide different types of feedback based on efficient or inefficient swimming technique.

FIG. 8 shows a swimmer with efficient freestyle form with an "early vertical forearm" or "high elbow catch." The swimmer is also maintaining a hand position with the palm facing backwards (to the direction of motion) and fingers pointing downwards at the catch phase and throughout most of the pull phase. The devices including the biofeedback system 100 would measure the orientation of the forearm and hand as vertical, close to the desired orientation. The devices including the biofeedback system 100 would then generate and provide positive sensory feedback to the user during these periods. A user seeking to learn and practice this technique could thus use the sensory inputs/augmentation from the devices including the biofeedback system 100 to achieve, correct, adjust and maintain efficient "early vertical forearm" or "high elbow catch" swimming technique while learning and practicing.

Other Modes and Features

In some embodiments, the device including the biofeedback system 100 can have settings for "early vertical forearm" such that the device can be programmed to provide sensory feedback as described above. The "early vertical forearm" is just one example of the type of modes the device can be programmed.

In another embodiment, the device including the biofeedback system 100 may be programmed with a "crossover mode." A common freestyle problem is when the swimmer's hand or arm crosses the center midline of the body in front of their head during the reach phase of the stroke. In this mode, user feedback can be generated to encourage the user to not allow their arm to cross over the midline of the body during the reach phase of the stroke.

Another desirable technique is for the user's body to be substantially straight and substantially parallel to the horizontal surface of the water. This body position can minimize water resistance or drag and maximize propulsion through the water. In one embodiment, the device including the biofeedback system 100 can be worn or attached to the hips. The device including the biofeedback system 100 would generate and provide feedback when the user's body is horizontal or close to horizontal to achieve the desired technique. In another embodiment, the device including the biofeedback system 100 can be programmed to provide feedback to encourage the horizontal orientation of the arms.

In another embodiment, the swimmer may use the device including the biofeedback system 100 to achieve a proper hand entry into the water which also achieves desirable shoulder rotation in the reach phase of the freestyle stroke. Embodiments of the device including the biofeedback system 100 can provide the swimmer with sensory feedback from a hand glove and a device strapped to the anterior forearm below the elbow to learn and practice the proper entry into water. Inefficient technique would include over rotation of the hand, arm, and shoulder during this phase, which can cause injuries common to swimmers such as swimmer's shoulder. The swimmer would set and program the device including the biofeedback system 100 such that sensory feedback would be generated and provided when the devices are close to a flat hand when entering the water during the reach phase of freestyle. A swimmer with inefficient freestyle technique incorporating of a thumb first and palm facing largely outward during the reach phase of the stroke. The device including the feedback system 100 would not generate or provide positive sensory feedback to the user during these periods.

In other embodiments, the device including the biofeedback system 100 can be used to promote a better streamline, synchronization between arms, synchronization between arms and legs, proper rotation for breathing techniques.

In some embodiments, the device including the biofeedback system 100 could have preset values for the range of angle deviation from the negative y-axis. In other embodiments, the device including the biofeedback system 100 could prompt the user to set a range of angle of deviation. In other embodiments, the predefined ranges may be preset such that the user selects their level of expertise.

The sensory feedback can be generated when the direction vector A of the swim paddle is within specified ranges of deviation from the desired angle of orientation. A "beginner" swimmer, may choose to specify a wider range of deviation that will generate positive sensory feedback, while an "expert" swimmer may choose a narrower range of deviation. For example, the user can select "expert" mode in which the device is programmed to provide sensory feedback within a small predefined range such as 10 degrees of deviation from the desired angle of orientation. For example, the user can select "beginner mode" in which the device is programmed to provide sensory feedback within a larger predefined range such as 30 degrees of deviation from the desired angle of orientation. In other embodiments, the user may directly set the angle of deviation such that they can customize their swimming drills and techniques to their individual problems and strokes.

In some embodiments, different parametric ranges or measurements could be selected depending on the skill and training objectives of the swimmer and coach. For example, the device including the biofeedback system 100 may measure the orientation of the roll and pitch of the body. For example, pitch can be measured as the angle of the body up and down from the surface of the water 520. For example, roll can be measured as the angle of rotation around the longitudinal axis of the body A device including the biofeedback system 100 may be worn on the body of a swimmer measuring the pitch and roll angles of the body. The device including the biofeedback system 100 could assist the swimmer in achieving a more streamlined body position in the water 520. A streamlined body position may reduce drag forces and to achieve a more powerful and effective swimming technique. For example, streamlined freestyle swimming requires the torso and legs of the swimmer to be aligned parallel to the horizontal surface of the water 520. If the hips drop below the level of the shoulders, there will be additional drag forces on the torso as it moves through the water 520. In this case, the pitch of the torso would be out of alignment with the horizontal surface of the water 520. The device including the biofeedback system 100 may measure the pitch angle of the body. For example, a device including the biofeedback system 100 may be worn in the middle of the swimmer's back between the hips. The device including the biofeedback system 100 may be programmed to provide sensory feedback to the swimmer to alert the swimmer if the hips have dropped and the torso is out of alignment with the horizontal surface of the water 520.

Freestyle swimmers can achieve a more powerful and propulsive pull by coordination of some rotation of the body around the body's longitudinal axis. The swimmer achieves this efficient pull this by rotating the body towards the pulling arm during the reach phase of the stroke on the pulling arm. The swimmer then rotates the body away from the pulling arm as the arm is the swimmer moves through the catch phase and the pull phase. The coordination of the pull with the body rotation adds force to the pull and thus leads to the generation of greater propulsion. A device including the biofeedback system 100 may be worn in the middle of the back between the hips to measures the roll angle of the body. The device including the biofeedback system 100 could be programmed to provide sensory feedback to the swimmer about how the body has rotated about the body's longitudinal axis, thus assisting the swimmer to coordinate their body rotation with the pulling motion.

Similarly, the device including the biofeedback system 100 can be programmed such that there is a training mode in which the desired orientation of the paddle could be set by the user. The device including the biofeedback system 100 can prompt the user to move through the phases of the stroke at particular positions. For example, the device including the biofeedback system 100 could prompt the user to first take a streamline position and take sensor measurements of body orientations. The device including the biofeedback system 100 could then prompt the user to move through the next desired position of the drill or stroke. The device including the biofeedback system 100 would then take sensor measurements. The microcontroller or hardware processor 108 would receive these sensor measurements and calculate the orientation angles. The microcontroller or hardware processor 108 could then set parameters for the haptic response as discussed more below. This process would be repeated for other defined positions and phases of the swim stroke.

Sensory Feedback Process

Figure 9:
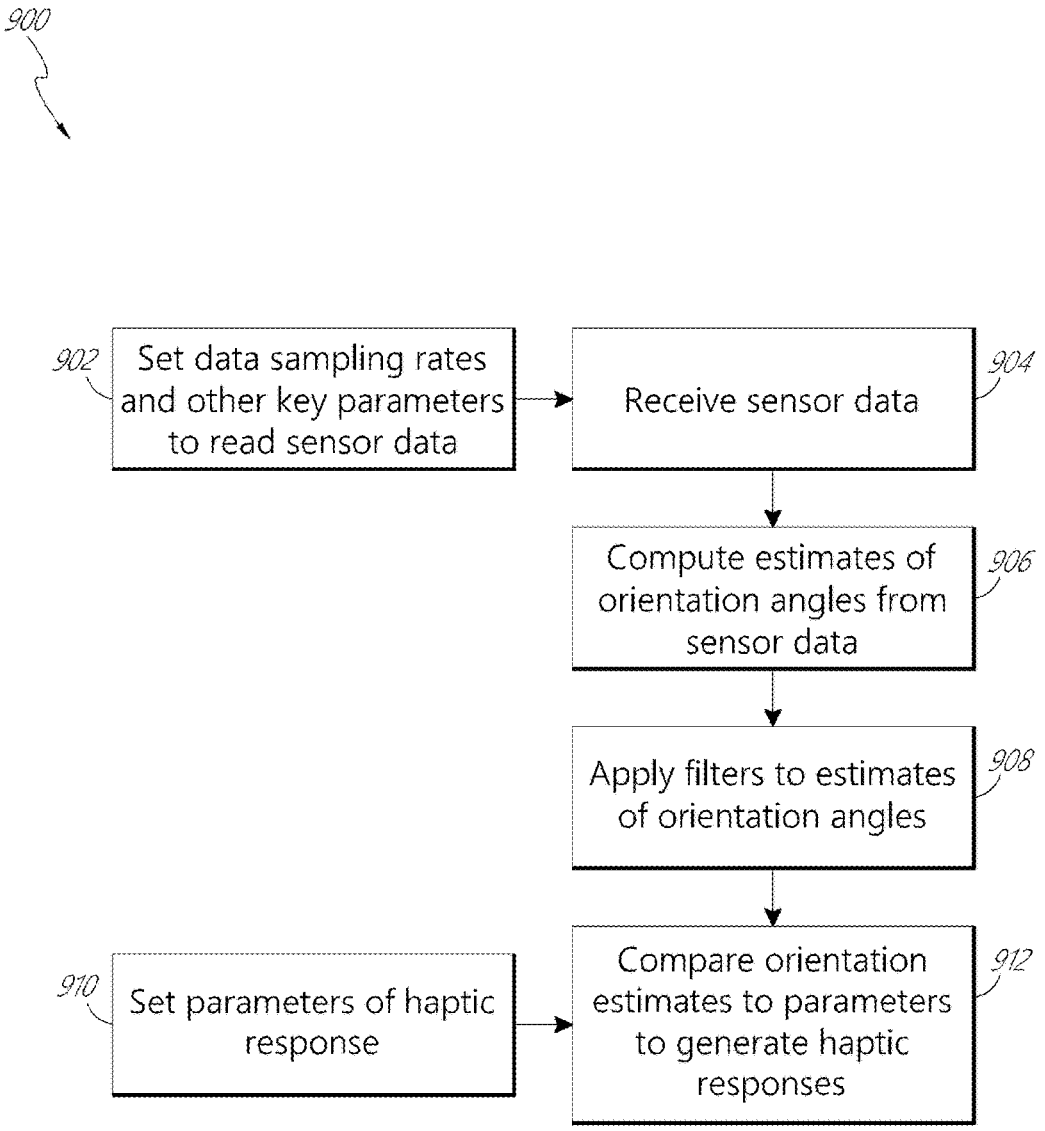
FIG. 9 illustrates an embodiment of a flowchart for determining the orientation of a body part and providing feedback to the user.

FIG. 9 illustrates an embodiment of a process 900 for determining the orientation of the body and providing feedback to the user. The process 900 can be implemented by any of the systems described above. In an embodiment, the process 900 is implemented by biofeedback system 100 using the microcontroller or hardware processor 108. The biofeedback system 100 can include programming instructions corresponding to processes described above and the process 900 described below. The programming instructions can be stored in a memory 110. In some embodiments, the programming instructions correspond to the processes and functions described herein. The programming instructions can be executed by a hardware processor or microcontroller 108. The programming instructions can be implemented in C, C++, JAVA, or any other suitable programming languages. In some embodiments, some or all of the portions of the programming instructions or functions can be implemented in application specific circuitry such as ASICs and FPGAs.

At block 902, the microcontroller 108 can set the data sampling rates and other parameters. These rates may be predetermined and stored in the memory 110. At block 904, the microcontroller 108 can receive sensor data from the orientation sensors 102 attached to one of the wearable devices discussed above. The sensor data can be measured by the orientation sensors 102 which can include an accelerometer, a gyroscope, a magnetometer, a tilt switch, any other type of sensor. For example, the sensor data may include force measurements or acceleration measurements from the orientation sensors 102. At block 906, the microcontroller 108 can calculate estimates of orientation angles as discussed above based on the sensor data and the parameters. In an embodiment, the estimation of orientation angle corresponds to transforming the received sensor data in view of the axis. At block 908, the microcontroller 108 can apply filters to the estimates of orientation angles. The microcontroller 108 can also average orientation data values to reduce effects of noise in the signal. These filters can include a Kalman filter, a complementary filter, and other filters.

At block 910, the microcontroller 108 can set parameters for the haptic response. These parameters can correspond to the angles discussed above and the specific swim techniques can be stored in the memory 110. At block 912, based on these parameters, the microcontroller 108 can define ranges to generate appropriate haptic responses.

In some embodiments, the microcontroller 108 may set parameters including the angles α and β as defined in FIG. 3A as defined above for the haptic response. The microcontroller 108 may define ranges of the angles α and β to generate appropriate haptic responses. For example, the range for α might be set at plus or minus 10 degrees deviation from the negative y-axis, while the range for β might be within 20 degrees from the negative y-axis. In some embodiments, the range for α might be set at plus or minus 15 degrees from the negative y-axis. In other embodiments, the response algorithm can generate other responses like visual or audio signals. The user would be able to choose through the user interface 112 the parameters they wish to set based on their skill level according to their training goals. These parameters may also be predefined at a default setting until the user made changes to the settings.

At block 912, the microcontroller 108 can compare orientation estimates calculated at block 908 and the defined ranges set at block 910. If the orientation estimates are within the defined ranges, the microcontroller 108 can generate a haptic response.

An example code corresponding to some of the aspect discussed above is shown below:

```
const int motorPin = [redacted];
// int minAngle =[redacted]; // The initial integer min value of the angle used to
fire the Buzz
// int maxAngle = [redacted]; // The initial integer max value of the angle used to
fire the Buzz
both means different things depending on mode set
// int SportMode = 1; // Swim(1),Bike(2),Run(3),Ski(4)etc.etc.
// int buzzmasterpositionMode = 1; // BuzzMaster on Head, on Back, on
ForeArm, On Hand, On Bike Helmet, etc. etc.
//
#include <SPI.h>
#include <Wire.h>
#include <Adafruit_Sensor.h>
#include <Adafruit_LSM9DS0.h>
#include <Adafruit_Simple_AHRS.h>
// Create LSM9DS0 board instance.
Adafruit_LSM9DS0   lsm(1000); // Use I2C, ID #1000
// Create simple AHRS algorithm using the LSM9DS0 instance's
accelerometer and magnetometer.
Adafruit_Simple_AHRS ahrs(&lsm.getAccel( ), &lsm.getMag( ));
// Function to configure the sensors on the LSM9DS0 board.
// You don't need to change anything here, but have the option to select
different
// range and gain values
void configureLSM9DS0(void)
{
    // 1.) Set the accelerometer range
    lsm.setupAccel(lsm.LSM9DS0_ACCELRANGE_2G);
//lsm.setupAccel(lsm.LSM9DS0_ACCELRANGE_4G);
    //lsm.setupAccel(lsm.LSM9DS0_ACCELRANGE_6G);
    //lsm.setupAccel(lsm.LSM9DS0_ACCELRANGE_8G);
    //lsm.setupAccel(lsm.LSM9DS0_ACCELRANGE_16G);
    // 2.) Set the magnetometer sensitivity
    lsm.setupMag(lsm.LSM9DS0_MAGGAIN_2GAUSS);
    //lsm.setupMag(lsm.LSM9DS0_MAGGAIN_4GAUSS);
    //lsm.setupMag(lsm.LSM9DS0_MAGGAIN_8GAUSS);
    //lsm.setupMag(lsm.LSM9DS0_MAGGAIN_12GAUSS);
```

-continued

```
    // 3.) Setup the gyroscope
    lsm.setupGyro(lsm.LSM9DS0_GYROSCALE_245DPS);
    //lsm.setupGyro(lsm.LSM9DS0_GYROSCALE_500DPS);
  //lsm.setupGyro(lsm.LSM9DS0_GYROSCALE_2000DPS);
}
void setup(void)
{
pinMode(motorPin, OUTPUT); //JD added
Serial.begin(115200);
Serial.println(F("JDs Swimcrawl test program 01/010/2017 Rev 1.0"));
Serial.println("");
  // Initialise the LSM9DS0 board.
if(!lsm.begin( ))
{
// There was a problem detecting the LSM9DS0 ... check your connections
Serial. print(F("Ooops, no LSM9DS0 detected ... Check your wiring or
I2C ADDR!"));
while(1);
  }
// Setup the sensor gain and integration time.
configureLSM9DS0( );
}
void loop(void)
{
sensors_vec_t   orientation;
// Use the simple AHRS function to get the current orientation.
while (ahrs.getOrientation(&orientation))
  {
/* 'orientation' have valid .roll and .pitch fields */
Serial.print(F("Catch Angle: "));
Serial.print(orientation.roll);
Serial.print(F(" "));
Serial.print(orientation.pitch);
Serial.print(F(" "));
// Serial.print(orientation.heading);
Serial.println(F(""));
//delay (10);
// JDs Check for CatchAngle and if met sound Haptic Motor Control
  if ((orientation.roll > [redacted]) && (orientation.roll <[redacted])&&
(orientation.pitch > [redacted]) && (orientation.pitch <[redacted]))
  {
digitalWrite(motorPin, HIGH);
// Serial.print(F("We are in if statement Haptic Should Fire "));
delay ([redacted]);
  }
else
{
digitalWrite(motorPin, LOW);
//delay (5000);
}
}
}
```

Sensory Feedback

In some embodiments, the sensory feedback generator 104 can produce sounds or audible signals. In other embodiments, the sensory feedback generator 104 can produce a light, multiple lights, or other visual signal. In some embodiments, the sensory feedback generator 104 may be enclosed in waterproof housing such that a visual signal is illuminated around the perimeter of the device. The visual signals may be secured and installed in a variety of configurations and positions such that the user may perceive the signals as the user swims.

The sensory feedback generator 104 can have different levels of intensity such as low, medium, high. The sensory feedback generator 104 can have different settings for the level of vibration or the pattern of vibration. Similarly, the sensory feedback generator 104 can have different settings for the type of sound produced, the volume of the sound produced, the pattern of the sound produced.

For example, the device can be programmed such that the intensity of the feedback signal is increased as the device approaches the optimum orientation and the intensity of the feedback signal is decreased as it deviates from the optimum orientation.

In some embodiments, the sensory feedback generator 104 may be secured within the circuit housing 402 such that a vibration signal can be transmitted throughout the rigid structure of the swim paddle 200 or wearable device 400. The sensory feedback generator 104 may be secured to the circuit housing 402 such that a visual signal is illuminated around the perimeter of the wearable device 400. The visual signals may be secured and installed in a variety of configurations such that the user may perceive the signals as the user swims.

The sensory feedback generator 104 can be programmed to provide positive feedback or negative feedback. In some embodiments, the device can provide positive sensory feedback when the user's body is in the desired orientation or position. In some embodiments, the device could provide negative sensory feedback such that the device is programmed to generate and produce sensory feedback when the user's body is in the wrong position. In some embodiments, the device could provide both negative and positive sensory feedback.

In one embodiment, the device could provide a positive sensory feedback of a green light and a negative feedback of a red light as the user goes through the stroke.

In some embodiments, the device could provide multiple types of sensory feedback, such as both vibration and lights. The sensory feedback generator 104 may also include a visual feedback element that would illuminate simultaneously with the vibratory feedback. This could be used to by the swimmer's coach to enhance their ability to observe the swimmer's hand orientation during the pull phase of the swimmer's stroke.

In one embodiment, the sensory feedback generator 104 can generate a haptic feedback signal around the attachment structure of the device. In another embodiment, the haptic feedback signal can be generated in a clockwise pattern or counterclockwise pattern around the attachment structure.

ADDITIONAL EMBODIMENTS

Any of the embodiments described above may be modified or added to as follows.

The biofeedback system 100 can include settings and parameters for other strokes such as breaststroke, backstroke, and butterfly. Other embodiments include settings and parameters for turns including flip turns, open turns for breaststroke and butterfly, turns to transition between different strokes appropriate for individual medley strokes. Other embodiments include settings and parameters for swimming starts including various styles of diving and backstroke starts. Embodiments of this device can include settings and parameters capable of sensing orientation of the body and providing sensory feedback to assist users in executing these techniques appropriately.

In some embodiments, the device may have preset programs in which the user selects the type of stroke, such as freestyle, breaststroke, backstroke, butterfly. The device may also have preset programs for the placement of the device, such as hand, forearm, upper arm, waist, chest, thigh, calf, ankle, or other body parts. The device may also have preset programs based of the level of expertise, such as beginner, intermediate, or expert.

The biofeedback system 100 can include settings and parameters for particular drills including closed first drills, hand drag drills, catch up drills, sideswims drills, and other drills. These drills are commonly used to improve swimming techniques. Embodiments of this device can include settings and parameters capable of sensing orientation of the body and providing sensory feedback to assist users in executing these drills techniques appropriately.

The biofeedback system 100 can be implemented on a variety of devices or placed in different orientations on different body parts. In some embodiments, the devices can be attached to a variety of swimming equipment like gloves, webbed gloves, pull buoy, axis buoy, ankle weights or cuffs, fins or flippers, swim caps, goggles, or swim socks or shoes. In other embodiments, the device can be attached to or embedded directly to swim suits.

The biofeedback system 100 can also be integrated into other devices such as smart watches sold by Garmin, Apple, Fitbit, Samsung, LG, Moment and other companies.

The biofeedback system 100 can also include be programmed for other sports. In one embodiment, the device can be programmed to include settings and parameters for diving, golf, weightlifting, climbing, gymnastics, bowling, skiing, track and field, baseball, tennis, and many other applications.

The biofeedback system 100 can also be programmed to suggest drills, level of expertise, or other settings based on sensor information collected from the user. In one embodiment, the biofeedback system 100 may measure the level of positive feedback generated and prompt the user to move to a higher level of expertise. In other embodiments, the biofeedback system 100 may analyze the motion of the user as it moves through the stroke and suggest specific programs like "early vertical forearm."

The biofeedback system 100 could be programmed to test the efficiency improvements of the adapted technique through performance measures such as speed and distance-per-stroke.

What is claimed is:

1. A method for controlling a sensory feedback generator that is configured to provide a haptic response, wherein the sensory feedback generator is included in a swim paddle, the method comprising:

receiving orientation data from an orientation sensor over a first period of time corresponding to a plurality of cycles of a freestyle swimming stroke, wherein each cycle comprises a first position corresponding to a catch phase and a second position corresponding to a pull phase;

determining an angle between a longitudinal axis of a low profile housing body of the swim paddle and a vertical axis that is perpendicular to a surface of water from the orientation data;

determining that the angle is within a range of 30 degrees or less from the vertical axis at the first position;

initiating the sensory feedback generator based on determining that the angle is within the range of 30 degrees or less from the vertical axis at the first position, thereby providing real-time feedback to a swimmer that they are executing the first position using correct technique, wherein the sensory feedback generator is configured to provide the haptic response when initiated; and continue generating the haptic response from sensory feedback generator based on the determination that the angle is within the range of 30 degrees or less from the vertical axis at the second position, thereby providing real-time feedback to the swimmer that they are executing the second position using correct technique;

wherein the low profile housing body of the swim paddle includes a hand surface and a water surface, the low profile housing body further including the longitudinal axis that is parallel to a length of a hand of the swimmer and a transverse axis that is parallel to a width of the hand, wherein the longitudinal axis is longer than the transverse axis, wherein the hand surface is adjacent to a palm of the hand, and wherein the water surface is adjacent to the surface of water;

wherein the swim paddle further comprises a strap configured to secure the low profile housing body with the hand of the swimmer, and wherein the swim paddle further comprises an electronics package configured to be affixed to the low profile housing body, the electronics package comprising, the sensory feedback generator, the orientation sensor, a battery, and a hardware processor.

2. The method of claim 1, further comprising generating the haptic response based on the range of 15 degrees or less from the vertical axis.

3. The method of claim 1, further comprising generating the haptic response based on the range of 20 degrees or less from the vertical axis.

4. The method of claim 1, further comprising generating the haptic response based on the range of 10 degrees or less from the vertical axis.

5. The method of claim 1, further comprising storing orientation data received from the swim paddle.

6. The method of claim 1, further comprising wirelessly connecting to a wireless communication device.

7. The method of claim 1, wherein the sensory feedback generator is positioned on the strap.

8. The method of claim 1, further comprising controlling the sensory feedback generator to generate a pattern of vibration.

9. The method of claim 1, further comprising generating the haptic response of a first pattern of vibration based on a first range from the vertical axis and generating the haptic response of a second pattern of vibration based on a second range from the vertical axis.

10. The method of claim 1, further comprising controlling the sensory feedback generator to generate a first pattern of vibration corresponding to a catch phase of a cycle of a freestyle swimming stroke and a second pattern of vibration corresponding to a pull phase of a cycle of a freestyle swimming stroke.

11. The method of claim 1, further comprising controlling the sensory feedback generator to increase the intensity of the haptic response as the angle approaches the vertical axis and to decrease the intensity of the haptic response as the angle departs from the vertical axis.

12. The method of claim 1, wherein the orientation sensor comprises a three axis accelerometer, a gyroscope, a magnetometer, or combinations thereof.

13. The method of claim 1, further comprising transferring the orientation data to a computing device for further review and analysis.

14. The method of claim 1, wherein the sensory feedback generator is configured to provide a visual response.

15. The method of claim 14, wherein the visual response generated is observable by an observer, coach, trainer, or other individual.

16. The method of claim 1, further comprising generating the haptic response based on the range of 30 degrees or less from the vertical axis; wherein the range of degrees from the vertical axis is set by the swimmer.

* * * * *